US006692187B2

(12) United States Patent
Sprengle, Sr. et al.

(10) Patent No.: US 6,692,187 B2
(45) Date of Patent: Feb. 17, 2004

(54) FLOOD GATE FOR DOOR

(75) Inventors: E. Carl Sprengle, Sr., Glassboro, NJ (US); E. Carl Sprengle, Jr., Glassboro, NJ (US); Michael Graham, Glassboro, NJ (US)

(73) Assignee: Smart Vent, Inc., Ocean City, NJ (US)

( * ) Notice: Subject to any disclaimer, the term of this patent is extended or adjusted under 35 U.S.C. 154(b) by 0 days.

(21) Appl. No.: 10/274,636

(22) Filed: Oct. 21, 2002

(65) Prior Publication Data

US 2003/0082008 A1 May 1, 2003

Related U.S. Application Data

(63) Continuation-in-part of application No. 09/821,397, filed on Mar. 29, 2001, now Pat. No. 6,485,231, which is a continuation-in-part of application No. 09/386,791, filed on Aug. 31, 1999, now Pat. No. 6,287,050, which is a continuation-in-part of application No. 09/079,611, filed on May 15, 1998, now Pat. No. 5,944,445.

(60) Provisional application No. 60/052,819, filed on Jul. 10, 1997.

(51) Int. Cl.[7] ..... E02B 7/20; E02B 7/40

(52) U.S. Cl. ..... 405/92; 405/95; 405/96; 405/99; 52/573.1

(58) Field of Search ..... 405/87, 92–96, 405/99, 100, 101, 102; 52/573.1, 1, 19, 169.5, 302.1, 473; 49/10, 11, 21, 23; 454/271, 273, 237, 238; 160/113, 116, 117, 118, 120, 205, 368.1, 94

(56) References Cited

U.S. PATENT DOCUMENTS

| | | | | | |
|---|---|---|---|---|---|
| 73,159 | A | * | 1/1868 | Besse | 405/96 |
| 2,105,735 | A | * | 1/1938 | Hodge | 49/193 |
| 2,118,535 | A | * | 5/1938 | Betts | 405/94 |
| 3,123,867 | A | * | 3/1964 | Combs | 49/21 |
| 3,927,709 | A | * | 12/1975 | Anderson et al. | 160/37 |
| 3,978,616 | A | * | 9/1976 | Pennock | 49/386 |
| 4,116,213 | A | * | 9/1978 | Kamezaki | 454/195 |
| 4,146,346 | A | * | 3/1979 | Salo | 405/80 |
| 4,231,412 | A | * | 11/1980 | Nowak | 160/213 |
| 4,378,043 | A | * | 3/1983 | Sorenson | 160/97 |
| 4,606,672 | A | * | 8/1986 | LeSire | 405/87 |
| 5,293,920 | A | * | 3/1994 | Vagedes | 52/302.1 |
| 5,408,789 | A | * | 4/1995 | Plfeger | 52/173.2 |
| 5,487,701 | A | * | 1/1996 | Schedegger et al. | 454/271 |
| 5,904,199 | A | * | 5/1999 | Messner | 160/219 |
| 5,994,445 | A | * | 11/1999 | Kaschel et al. | 524/444 |
| 6,092,580 | A | * | 7/2000 | Lucas | 160/113 |
| 6,287,050 | B1 | * | 9/2001 | Montgomery et al. | 405/92 |
| 6,485,231 | B2 | * | 11/2002 | Montgomery et al. | 405/92 |

FOREIGN PATENT DOCUMENTS

| | | | | |
|---|---|---|---|---|
| GB | 2147933 | * | 5/1985 | 405/97 |

* cited by examiner

*Primary Examiner*—Jong-Suk (James) Lee
(74) *Attorney, Agent, or Firm*—Akerman Senterfitt

(57) ABSTRACT

A flood gate is provided that includes a frame defining a fluid passageway, a door pivotally mounted in the frame for movement between a plurality of open positions to permit flow of fluid therethrough, and at least one latching mechanism for holding the door in the closed position. The latching mechanism can release the door when the fluid force meets a preset level, by floatation, or by flow actuation. In addition, the latching mechanism can reset the door to the closed position when the fluid force acting on the door drops below the preset level. The door can include a ventilation opening, an automatic louver assembly for controlling air flow through the ventilation opening and a screen covering the ventilation opening. The flood gate may include a retention mechanism for preventing the door from opening when the structure in which the flood gate is mounted, such as an overhead garage door is rotated or otherwise moved.

16 Claims, 17 Drawing Sheets

FIG. 14d
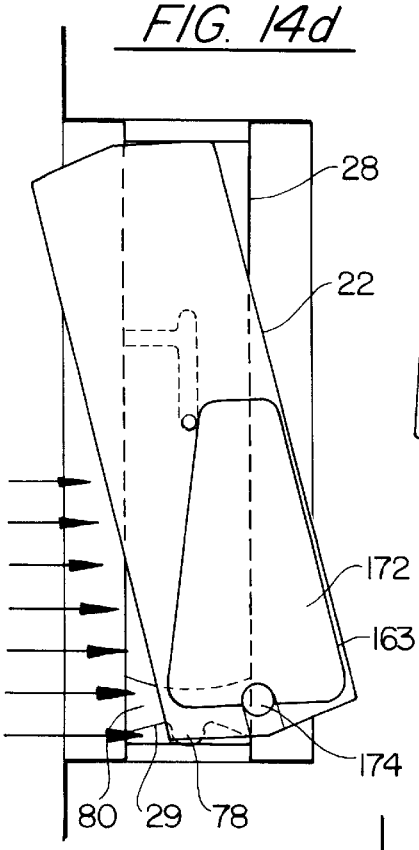
FIG. 14e
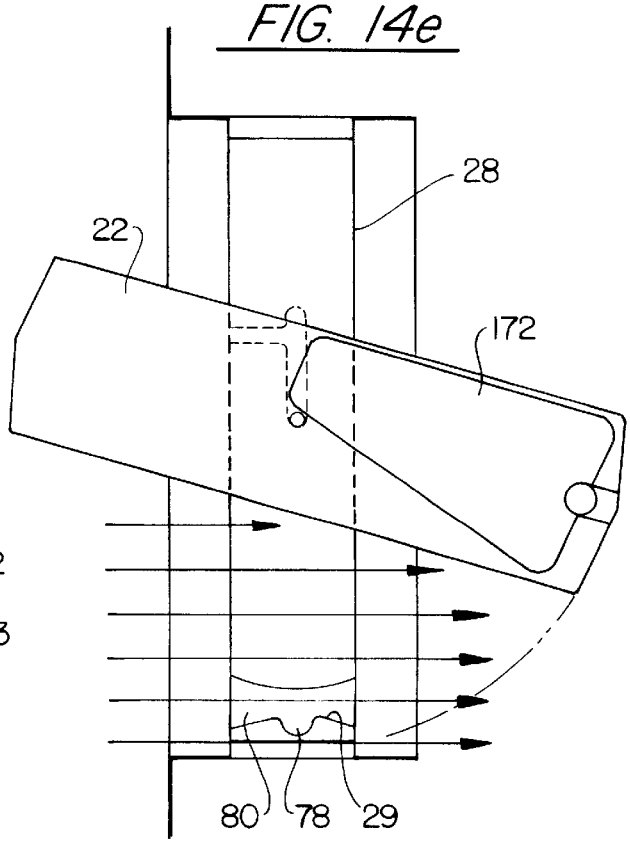
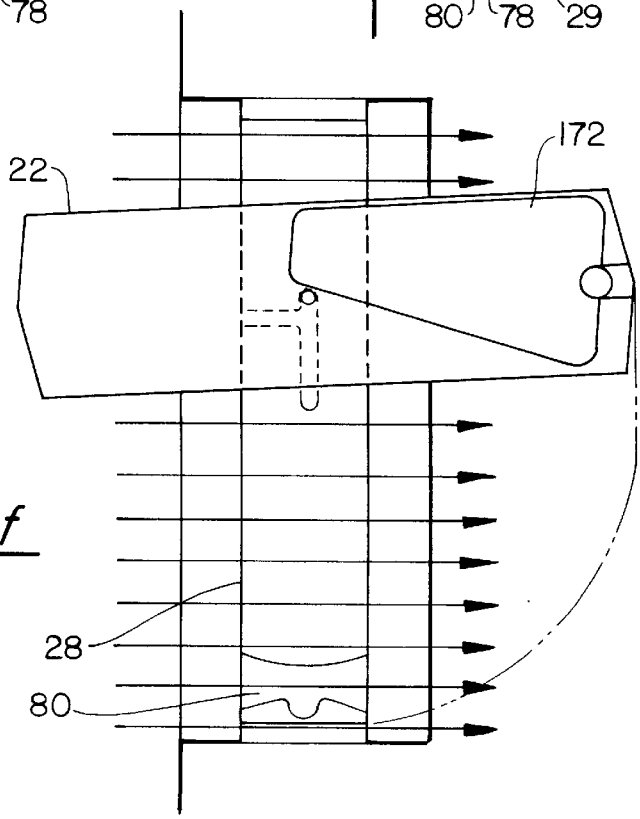
FIG. 14f

FLOOD GATE FOR DOOR

CROSS REFERENCE TO RELATED APPLICATION

This is a Continuation-In-Part of U.S. patent application Ser. No. 09/821,397 filed Mar. 29, 2001, now U.S. Pat. No. 6,485,231, which is a Continuation-in-Part of U.S. patent application Ser. No. 09/386,791 filed Aug. 31, 1999, now U.S. Pat. No. 6,287,050, which is a Continuation-In-Part of U.S. patent application Ser. No. 09/079,611 filed May 15, 1998, now U.S. Pat. No. 5,944,445, which claims the benefit of provisional application number U.S. Pat. 60/052,819 filed Jul. 10, 1997.

FIELD OF THE INVENTION

This invention relates generally to flood water control devices for enclosed areas below base flood plain levels, and more particularly, to flood water control devices for venting enclosed spaces within a foundation, garage, foyer, an entry, basement or other such area.

BACKGROUND

To help limit flooding damage, several building code organizations and the federal government have promulgated regulations that mandate that buildings with enclosed spaces located below base flood plain levels, such as crawl spaces, must provide for automatic equalization of interior and exterior hydrostatic forces caused by flooding fluids such as water. According to these regulations, flooding fluids must be permitted to enter and exit the enclosed spaces freely. In particular, many of these regulations require builders to install a number of vents in the enclosed spaces. For example, federal regulations require flood venting for all new construction in flood-prone areas and where renovations to an existing structure exceed fifty percent of the value of the property.

In addition to the regulations mentioned above, good construction practice embraces the use of vents which can be opened during warmer months to allow for ventilation to permit moisture to escape from crawl spaces, while retaining the ability to close during colder months to prevent the circulation of cold air around exposed plumbing in crawl spaces. Typically, the use of screening and louvers is necessary to achieve both the warm weather and cold weather requirements of proper venting and is required by at least some building codes for openings in foundation walls. As a result, a flood vent must be able to automatically remove the louver and screen barrier when confronted with free-flowing, flooding fluids.

Generally, a wide variety of devices have been developed which may be utilized to provide pressure relief from both liquid and gaseous forces. With respect to gas pressure relief devices, U.S. Pat. No. 3,680,239, issued Aug. 1, 1972 to Burtis for PRESSURE EQUALIZING VALVE, discloses a device to relieve overpressure and underpressure in the opening and closing of a door of a refrigerated space. U.S. Pat. No. 2,774,116, issued Dec. 18, 1956 to Wolverton for DOUBLE ACTING RELIEF VALVE, U.S. Pat. No. 2,798,422, issued Jul. 9, 1957 to Bourque for AIR RELIEF MEANS FOR DOORS, and U.S. Pat. No. 3,123,867, issued Mar. 10, 1964 to Combs for VESTIBULE PRESSURE EQUALIZER, relate to the equalization of differential air pressure experienced in the swinging of one door relative to another door. Additionally, U.S. Pat. No. 2,105,735, issued Jan. 18, 1938 to Hodge for PRESSURE RELEASING APPARATUS, and U.S. Pat. No. 4,116,213, issued Sep. 26, 1978 to Kamezaki for AIR PRESSURE CONTROL APPARATUS FOR A HOT OR COLD STORAGE CHAMBER, teach methods to release pressure in closed chambers resulting from changing temperatures within the chamber. In particular, the Kamezaki apparatus utilizes a swinging damper hinged at the top of an enclosing frame. Nevertheless, neither the Kamezaki apparatus nor other inventions contemplate the use of a vented damper able to relieve pressure resulting from fluid flow.

Correspondingly, several devices have been developed which provide relief from overpressure resulting from the flow of water and other liquids. U.S. Pat. No. 4,349,296, issued Sep. 14, 1982 to Langeman for IRRIGATION DITCH GATE, describes a gate for an irrigation ditch, which during normal conditions through the use of tensioned springs, maintains flood gates in a closed position, but upon flood conditions, allows for the gates to open. U.S. Pat. No. 3,939,863, issued Feb. 24, 1976 to Robison for BASEMENT SUMP CONSTRUCTION, discloses a basement drain containing a trap for the prevention of back flow of flood water. U.S. Pat. No. 4,174,913, issued Nov. 20, 1979 to Schliesser for ANIMAL GUARD FOR FIELD PIPE, relates to an invention which, while allowing for the free-flow exit of debris carrying effluents from an open pipe end, prevents animal entry into the pipe. Still, none of the aforementioned devices contemplate the integration of a liquid flow control device with a temperature controlled ventilation system.

Presently, several patents disclose methods for ventilating enclosed foundation spaces. U.S. Pat. No. 5,293,920, issued Mar. 15, 1994 to Vagedes for LOUVERED BASEMENT VENT, and U.S. Pat. No. 5,487,701, issued Jan. 30, 1996 to Schedegger et al. for PLASTIC FOUNDATION VENT, embody louvered basement vents which can be manually adjusted to limit air flow in colder temperatures and to maximize air flow in hotter conditions. U.S. Pat. No. 5,460,572, issued Oct. 24, 1995 to Waltz et al. for FOUNDATION VENTILATOR, discloses merely a one-piece molded plastic foundation ventilator without louvers. The Waltz invention, however, contemplates the manual use of hinged doors to regulate air flow through to the foundation. U.S. Pat. No. 2,754,747, issued Jul. 17, 1956 to Bertling for AIR REGISTER OR LOUVER, embodies a hinged, louvered door designed to facilitate the maintenance of the screen behind the louvered door. Nonetheless, the louvers are designed to be operated manually by the user.

All of the aforementioned foundation ventilators contain screening to prevent small animals and other pests from gaining access to the enclosed area, as required by the model building codes for openings in foundation walls. Significantly, none of the aforementioned foundation ventilators will act as a pressure relief valve in response to the ebb and flow of flooding fluids. Furthermore, few provide for the automatic adjustment of louvers in a flood gate in response to increasing or decreasing temperature so as to prevent either the rotting of the elements of the structure's foundation or the freezing of pipes within the enclosed space. Accordingly, the prior art has not provided an integrated apparatus that automatically ventilates an enclosed space of a foundation, allows for the relief of fluid pressure on either side of the vent and prevents small animals and other pests from entering the enclosed space.

SUMMARY OF THE INVENTION

The subject invention has advantages over all current air vents now used and provides a novel and nonobvious opening for the entry and exit of flooding fluids such as water. The low-maintenance flood vent can be installed in new and existing crawl spaces and foundations and can remain in use year round. These vents have particular utility in areas designated by the Federal Emergency Management Agency (FEMA) as flood prone areas. When installed, the vent will allow for the free passage of air ventilation in warm temperatures and the temperature controlled louvers will close fully in colder temperatures.

Also, the louvered panel will be screened to prevent penetration by small animals and other pests and will operate like a pivotally connected gate. The panel can be secured in the closed position by a latching mechanism that senses the height and the direction of the flow of fluid surrounding the vent and releases the panel at a predetermined height.

A vent in accordance with an inventive arrangement can remain open for regular air ventilation in warm weather conditions, can close to block off air flow during cold weather conditions and can, at any time, open to enable the passage of flooding fluid into and out of the crawl space.

The present invention relates to a flood gate. The flood gate includes a frame defining a fluid passageway therethrough and a door pivotally mounted in the frame for rotation between a plurality of open positions to permit flow of fluid therethrough. The flood gate also includes at least one latching mechanism for holding the door in the closed position. The latching mechanism senses the fluid force acting on the door and releases the door when the fluid force meets a preset level.

In one aspect of the invention, the latching mechanism include a float to determine the level of the fluid force. In addition, the float can be disposed within the door. In this arrangement, the door can contain at least one aperture for permitting the fluid force to act upon the float.

In another arrangement, the flood gate can have a sensing and releasing device which can sense the fluid force acting on the float and can release the door when the fluid acting on the float meets the preset level. In addition, the frame can define an open slot adjacent the float. Further, the sensing and releasing device can be a pin extending from the float, and the pin can be adapted to be inserted into the open slot. Positioning the pin within the open slot can prevent the door from pivoting.

In another arrangement, the open slot can include an opening in which the position of the opening determines the preset level. When the fluid force acting upon the float meets the preset level, the pin can exit the opening of the open slot and the pin can be unconstrained by the open slot. This can enable the door to rotate between the open positions. In addition, the frame can define a channel which can enable passage of the pin through the frame when the door rotates between the open positions. In another aspect, the latching mechanism can reset the door to the closed position when the fluid force acting on the door drops below the preset level.

In another arrangement, the flood gate can include at least one stake for attaching the flood gate to a structure. Each stake can include a longitudinal member and an attachment portion. In another aspect, the frame can define a tine slot for receiving the longitudinal member in which the longitudinal member can be insertable into the tine slot in one direction and resistant to removal in an opposite direction.

In yet another aspect, the frame can define opposing door slots in which the door slots include opposing door pins respectively positionable within the opposing door slots. Each door slot can include a bottom which can define a resting vertical and horizontal position of the door pins upon insertion into the door slots. In addition, each door slot can include a door slot opening which can be positioned above the resting vertical and horizontal position. Also, each door pin can be respectively pivotable within the door slot.

In another aspect of the invention, the door can include a ventilation opening, an automatic louver assembly for controlling air flow through the ventilation opening and a screen covering the ventilation opening. In one arrangement, the automatic louver assembly can open and close in response to ambient temperatures. The automatic louver assembly can have at least one louver, a temperature sensitive actuating device and a member connecting the louver to the temperature sensitive actuating device.

Another aspect of the invention includes a bracket for preventing the flood door from opening when the structure in which the flood door is mounted, such as an overhead garage door, is rotated or moved from a generally vertical position to a generally horizontal position. The bracket operates by preventing the locking mechanism from releasing and allowing the flood door to open. In one embodiment, the bracket is an arm that is rotatably mounted to the flood door or frame. As the frame of the flood door is rotated with the structure in which the flood door is mounted, such as an overhead garage door, the bracket rotates around a pivot point and prevents the float from moving. Prohibiting the float from moving prevents a locking pin from being removed from an open slot, and therefore, prevents the flood door from opening.

These and other features and advantages of the present invention will become apparent after review of the following drawings and detailed description of the disclosed embodiments.

BRIEF DESCRIPTION OF THE DRAWINGS

Presently preferred and alternative embodiments of the inventive arrangements are shown in the drawings, it being understood, however, the inventive arrangements are not limited to the precise arrangements and instrumentalities shown.

FIGS. 14*c–f* are cross-sectional side elevations of the flood vent in FIG. 14*a* sequentially illustrating the sequential opening of a door by the force of flowing fluid.

DETAILED DESCRIPTION OF THE PREFERRED EMBODIMENTS

Figure 1A:
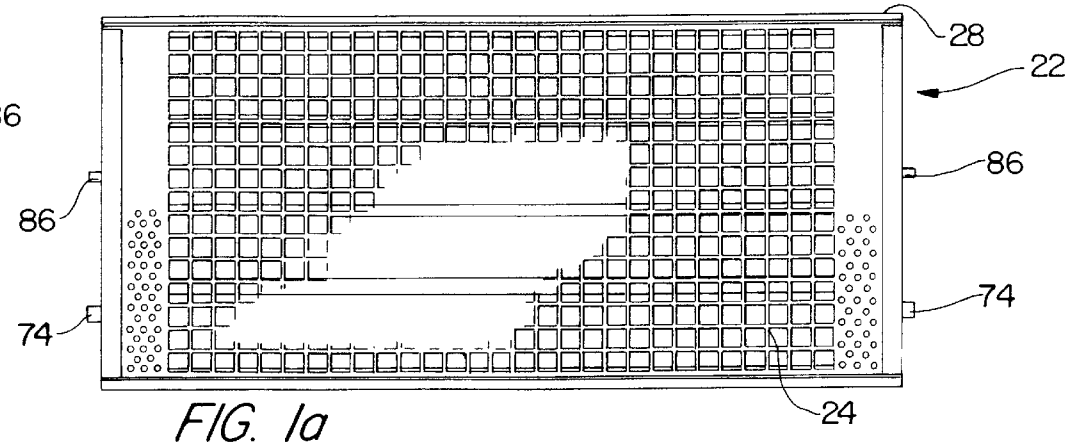
FIG. 1*a* is a front elevation of a door of a flood vent according to the invention.
Figure 1B:
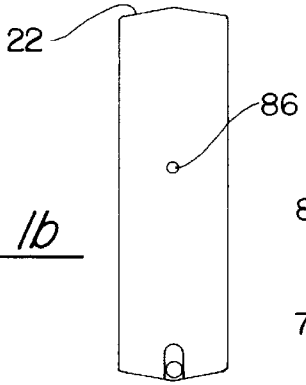
FIG. 1*b* is a side elevation of the door in FIG. 1*a*.
Figure 2A:
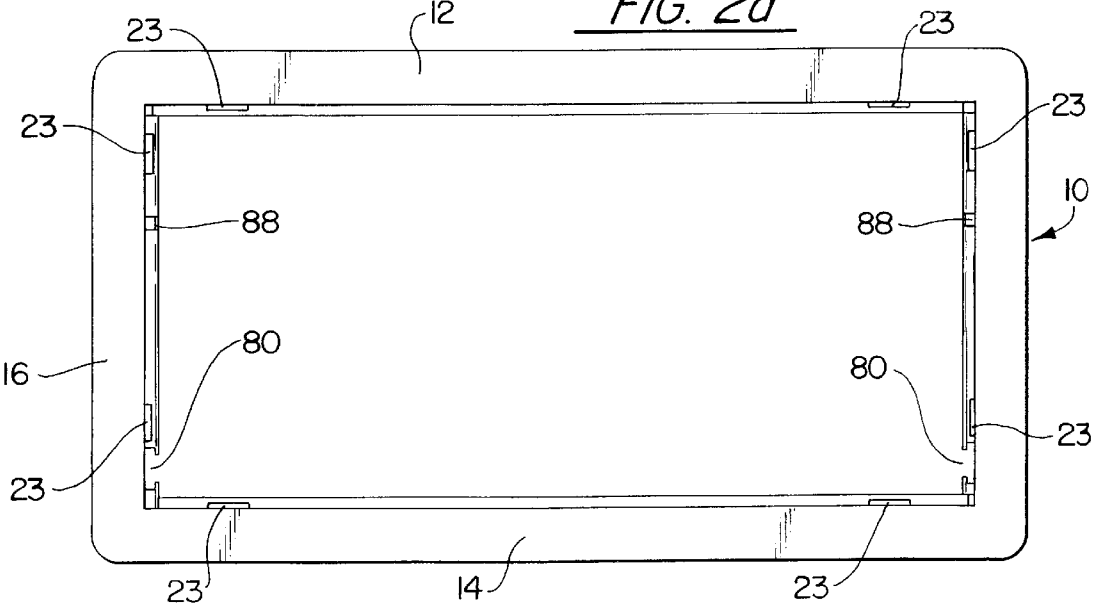
FIG. 2*a* is a front elevation of a frame of a flood vent.

FIGS. 1 and 2 illustrate a vent 8 according to a preferred embodiment of an inventive arrangement. The vent 8 can have a frame 10 formed from a corrosion resistant material, preferably stainless steel. The frame 10 is not limited as to a particular dimensioning; however, in one arrangement, the frame 10 can be in dimensions of 8"×16." In the one embodiment, the top rail 12 and the bottom rail 14 each can be approximately 17 11/16" long, and the side rails 16 can be approximately 9 11/16" long.

Figure 2B:
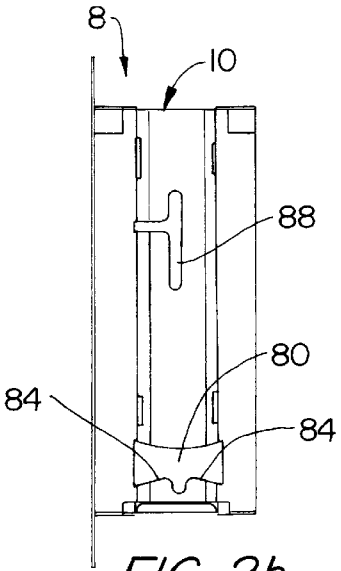
FIG. 2*b* is a side elevation of the frame in FIG. 2*a*.

A door 22 can be attached to the frame 10 so that the door 22 can pivot relative to the frame 10. Many features capable of pivoting the door 22 relative to the frame 10 are well known in the art, and all such features are acceptable for use with this invention; however, the presently preferred features to attach the door 22 to the frame 10 are door pins 86 which can extend from sides of the door 22. The door pins 86 can be adapted to be received within door slots 88 which can be disposed within the frame 10. As shown in FIG. 2*b*, the door slots 88 can be T-shaped. This configuration can allow the door pins 86 to rise in the door slots 88 which can permit the door 22 to rise in response to flooding. Significantly, however, the design of the door slots 88 can prevent the door 22 from being easily removed during flooding conditions and can deter entry by unauthorized persons or pests.

The door 22 is preferably made with a corrosion-resistant material, most preferably stainless steel. The door 22 also preferably comprises two mesh grilles 24 which can be disposed on opposing faces of the door 22. Although the mesh grilles 24 can allow air to pass through the door 22, the size of the openings in the mesh grilles 24 can be sufficiently small to prevent objects such as small animals, as required by model building codes for openings in foundation walls, from passing through the door 22.

Any means of securing the frame 10 to a wall opening is acceptable. An example of a securing means is a set of stainless steel set screws. Divots can be drilled in the building prior to insertion of the setting screws to ensure proper security. Also, the perimeter can be caulked as required.

As illustrated in FIGS. 3–6, a presently preferred means of securing the frame 10 to a wall 17 is with one or more stakes 11. The stakes 11 can include a forked longitudinal member 13 and an attachment portion 15. The attachment portion 15 can be bent at predetermined positions based on the thickness of the wall 17. Thus, the wall 17 can be wedged between the frame 10 and the bent portion of the attachment portion 15. The attachment portion 15 preferably includes a slot or hole through which a fastener, such as a nail or screw, can be inserted into the wall 17 thereby securing the frame 10 to the wall 17. The forked longitudinal member 13 preferably includes a pair of tines 19; however, the invention is not so limited, as the forked longitudinal member 13 can contain any number of tines 19.

Figure 3:
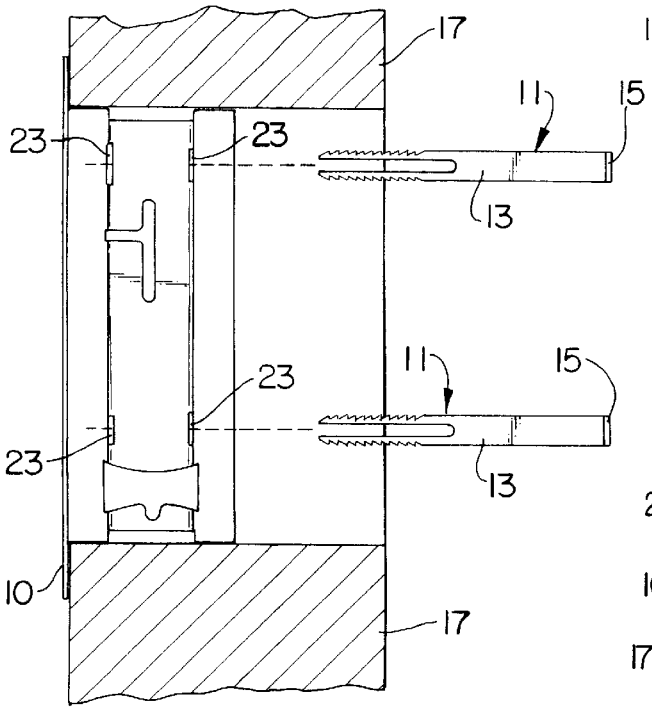
FIG. 3 is a side elevation of a flood vent inserted into a wall and stakes for attaching the flood vent to the wall.
Figure 4:
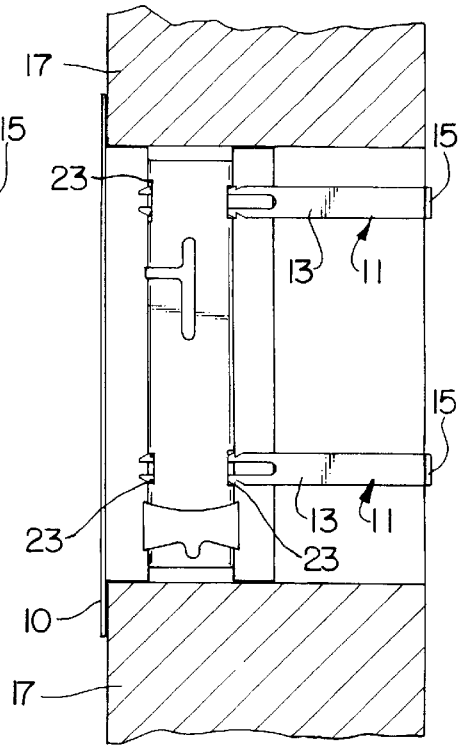
FIG. 4 shows the stakes of FIG. 3 inserted into a frame of the flood vent.
Figure 5:
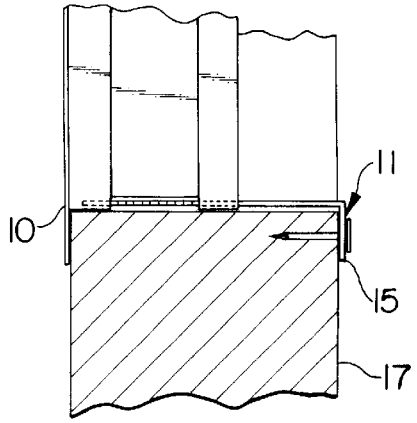
FIG. 5 is an expanded sectional side elevation of a stake attached to a wall.
Figure 6:
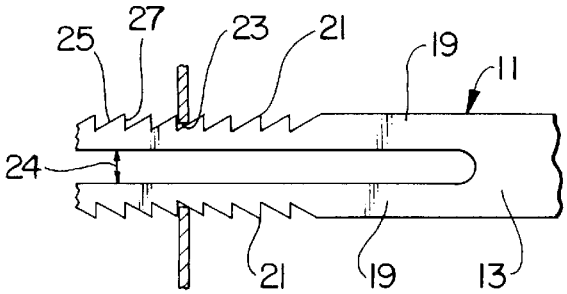
FIG. 6 is an expanded partial side elevation of the stake in FIG. 4 inserted into a frame of a flood vent.

The tines 19 can be configured to be inserted into a slot 23 in the frame 10 in one direction but resistant to removal in the opposite direction. The number of slots 23 contained in the frame can be based on the number of stakes 11 included in the invention; however, any number of slots 23 can be contained in the frame 10. Any feature on the tines 19 that resists removal in an opposite direction is acceptable; however, the presently preferred feature is one or more teeth 21. The teeth 21 can be externally mounted on the tines 19, as shown in FIGS. 3 and 6. It should be noted, however, that the invention is not limited in this regard, as the teeth 21 can be can be internally mounted on the tines 19 such that the teeth 21 on opposing tines 19 will face towards each other. In this arrangement, each tine 19 containing the internally mounted teeth 21 can be inserted into an appropriately sized slot 23 or pair of slots 23 in one direction but resistant to removal in the opposite direction.

The teeth 21 can also be both externally and internally mounted on the tines 19. In this arrangement, the frame 10 can include one or more slots 23 for receiving one or more tines 19 containing both internally and externally mounted teeth 21. Similar to the previously discussed teeth 21 arrangements, each tine 19 with both internally and externally mounted teeth 21 can be inserted into an appropriately sized slot in one direction but resistant to removal in an opposite direction. As shown in FIG. 6, each tooth 21 can be configured with a first contact surface 25 and a second contact surface 27. In one arrangement, the width of the forked longitudinal member 13 is greater than the width of each slot 23, and the distance 24 between the tines 19 is at least as great as the difference between the width of the forked longitudinal member 13 and the width of each slot 23.

In a preferred embodiment, each of the first contact surfaces 25 can be oriented at an angle relative to the direction the stake 11 is to be inserted into the slot 23. Further, each of the second contact surfaces 27 can be oriented substantially perpendicular to the insertion direction of the stake 11. Pressure from inserting the stake 11 into the slot 23 against the first contact surface 25 can force the tines 19 towards one another and can enable the stake 23 to be inserted into the slot 23. Also, because the second contact surface 27 can be oriented substantially perpendicular to the insertion direction, the second contact surface 27 can prevent removal of the stake 11 from the slots 23; however, the stake 11 can be removed from the slots 23 if the tines 19 are forced together such that the combined width of the tines 19 and teeth 21 is less than the width of the slots 23.

This preferred embodiment of the attachment means has several advantages. Specifically, no tools are needed to install the device. In addition, since the door 22 can be completely removed from the frame 10 during installation, maintenance, cleaning or removal, access to the inner surface of the wall 17 can be achieved without entering the structure. During installation, the frame 10 can be placed in a prepared opening in the wall 17. The stakes 11, which can be bent based on the thickness of the wall 17, can then be positioned through the opening in the frame 10 with the bent attachment portion 15 of the stake 11 placed behind the wall 17. Further, the forked longitudinal member 13 of the stake 11 can be inserted into the slot 23 of the frame 10. As a result, the wall 17 can be secured between the frame 10 and the stake 11. The installation process can then be repeated for each of the remaining stakes 11. These stakes can then be anchored to the wall 17 with a fastener, such as a screw or nail. Once the frame is secured to the wall 17, the door 22 can be installed in the frame 10.

Once attached to the wall 17, the frame 10 can be difficult to remove. However, if the frame 10 does have to be removed for maintenance or any other purpose, forcing the tines 19 together can enable the stakes 11 to be removed from the slots 23 and can thereby allow the frame 10 to be removed from the wall 17. Because this is a difficult and nonobvious process, however, it can discourage removal of the frame 10 by unauthorized persons.

Figure 7:
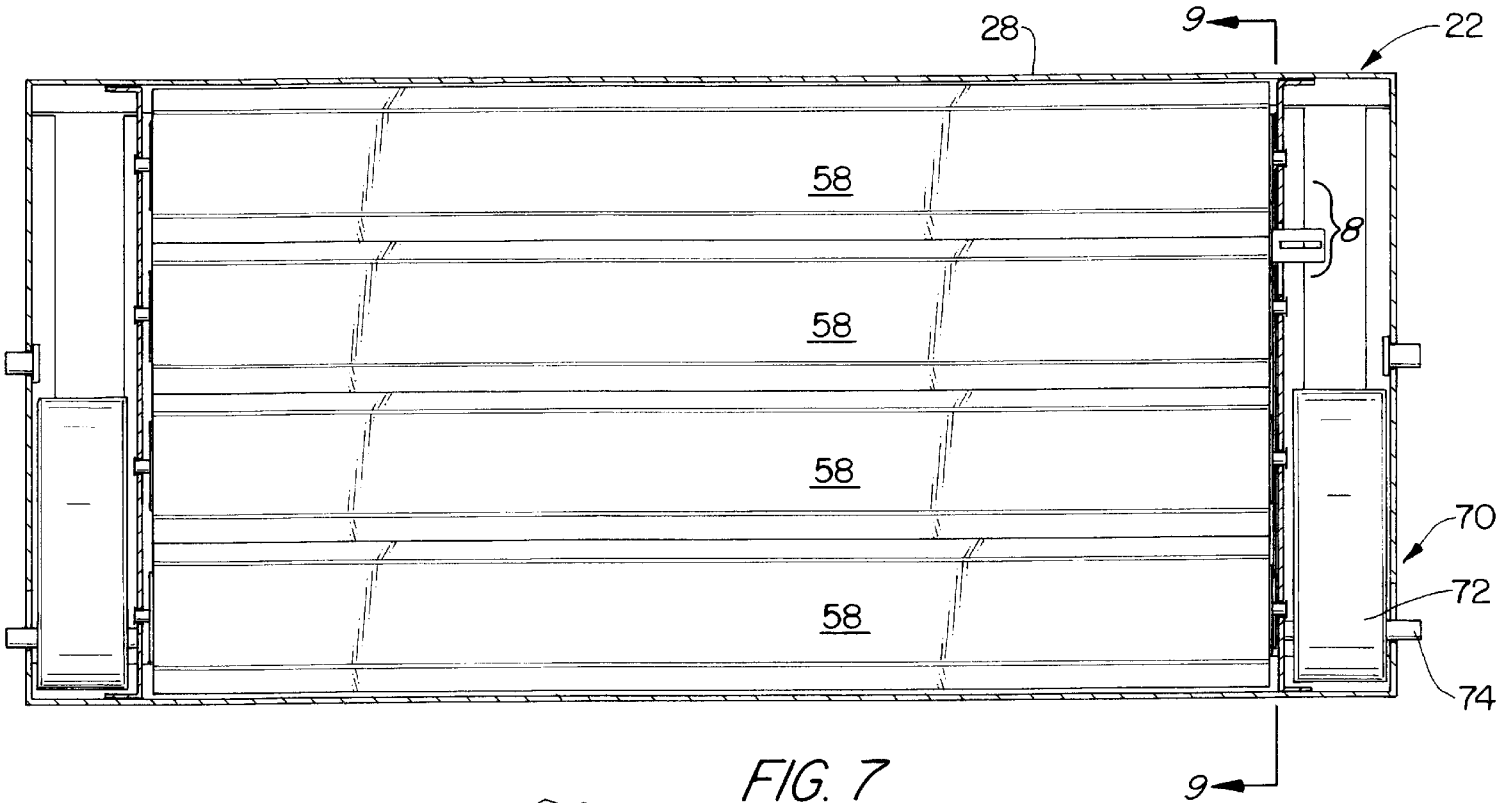
FIG. 7 is a sectional elevation of the door in FIG. 1*a*.
Figure 8:
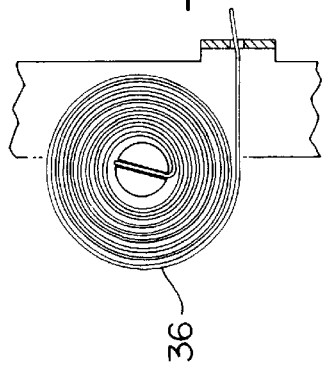
FIG. 8 is a detailed side elevation of a temperature sensitive actuating device.
Figure 9A:
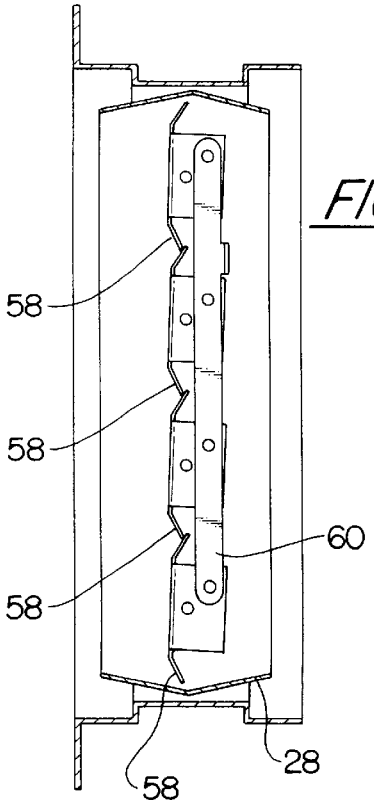
FIG. 9*a* is a cross section taken along line 9—9 in FIG. 7 showing louvers in a closed position.
Figure 9B:
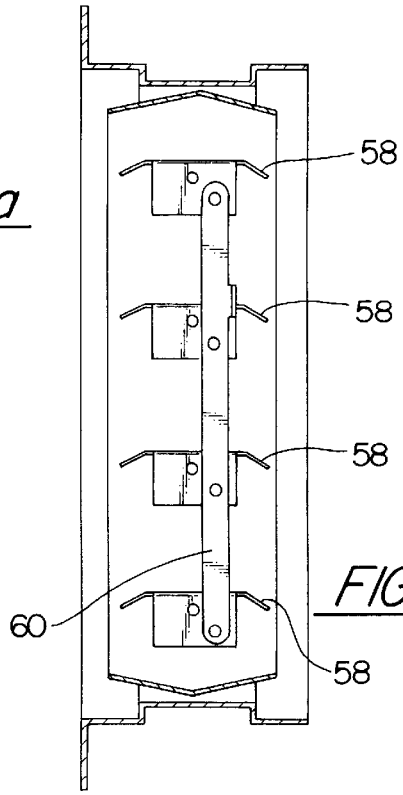
FIG. 9*b* is a cross section taken along line 9—9 in FIG. 7 showing louvers in an open position.
Figure 10:
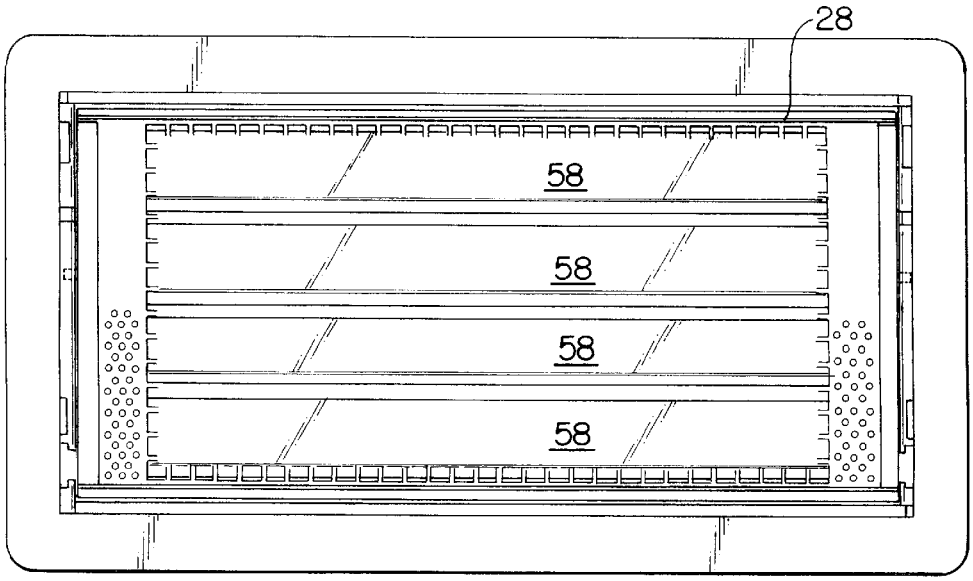
FIG. 10 is a front elevation of a flood vent showing louvers in a closed position.

FIGS. 7 and 9–10 illustrate the substantially equally spaced positioning of louvers 58 within a door frame 28. Although these drawings illustrate the door frame 28 as containing four louvers 58, the invention is not so limited. In fact, the door frame 28 can contain any number of louvers 58. A vertical rod 60, preferably made from a corrosion-resistant, strong material such as stainless steel, can be coupled to each louver 58, as shown in FIGS. 9*a* and 9*b*. Referring to FIG. 8, the vertical rod can be coupled to a temperature sensitive actuating device 36. The temperature sensitive actuating device 36, so named because the device translates thermal inputs into physical motion, can be adjusted to drive the louvers 58 open through vertical rod 60 during warm temperatures and to substantially fully close the louvers 58 through vertical rod 60 when the temperature falls below approximately forty degrees Fahrenheit. In one arrangement, the temperature sensitive actuating device 36 can be a bimetallic coil. It should be noted, however, that the invention is not limited in this regard, as the actuating device 36 can be wax elements, thermal pistons, thermal bellows, a snap acting disc or leaf, a thermal diaphragm, a helical coil or a spiral band or mechanism utilizing electronic sensors and motorized actuators or any other suitable temperature activated device.

FIG. 7 illustrates the latching mechanism 70. The latching mechanism 70 can operate by sensing the level or flow of fluids, such as water, passing through the door frame 28 and, at a preset level, can release the door 22. At a time when the level of fluid has decreased sufficiently so that the door 22 hangs substantially perpendicular to the ground, the latching mechanism 70 can be reset, which in turn can return the door 22 to its pre-release position. Although any type of latching mechanism 70 so capable is acceptable, the presently preferred latching mechanism uses a float 72, which can indicate the level or flow of the fluid. Although the float 72 is positioned within the door 22, the invention can be configured so that fluid contacts the float 72. Moreover, the invention is not limited to two floats as illustrated in FIG. 7, as the invention can contain any number of floats 72. Once the float 72 is lifted by the height or flow of the fluid to a preset level, the door 22 can be released. Many types of devices are capable of sensing the float 72 at a preset level and capable of subsequently releasing the door 22, and the invention is not limited as to a particular type of sensing and releasing device.

Figure 11A:
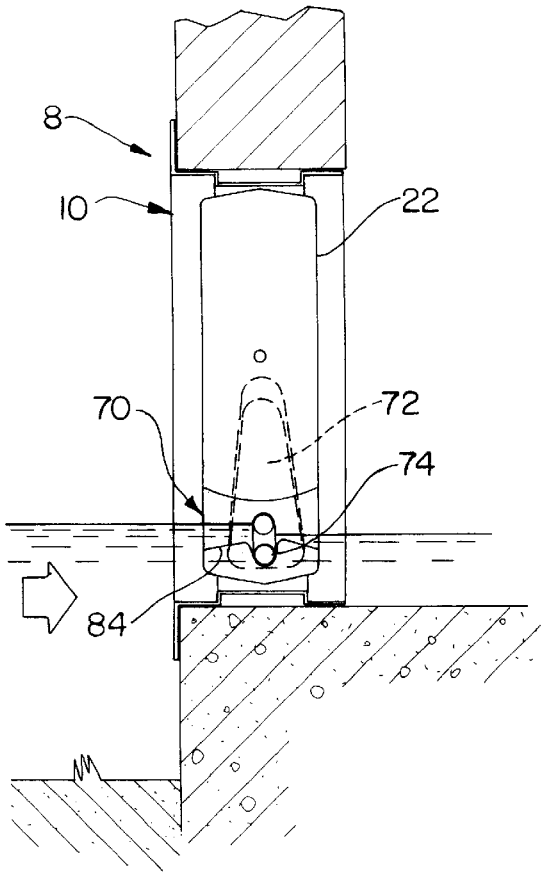
FIG. 11*a* is a cross-sectional side elevation of a flood vent showing the reaction of a float to an increasing or a decreasing fluid level.
Figure 11B:
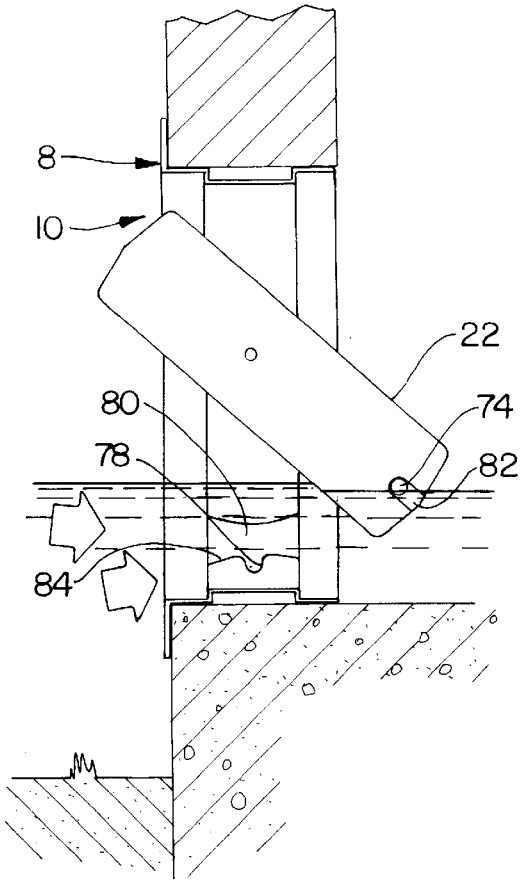
FIG. 11*b* is a cross-sectional side elevation of a flood vent showing a door swinging open after a float has released the door.

In one arrangement, the sensing and releasing device can be a pin 74 extending from the float 72. Referring to FIGS. 11*a* and 11*b*, the pin 74 can be adapted to be inserted into an open slot 78 in the frame 10. As illustrated in FIG. 11*a*, when the pin 74 is positioned within the open slot 78, the door 22 can be prevented from swinging in either direction. The position of the opening of the open slot 78 determines the level of fluid at which the door 22 can open. Once the float 72 is lifted by fluid such that the pin 74 exits the opening of the open slot 78, the pin 74 is not constrained by the open slot 78 and can rotate in the direction of the current of the fluid, as illustrated in FIG. 11*b*.

The frame 10 also preferably includes a channel 80 which can allow the pin 74 to pass through the frame 10 as the door 22 rotates. The width of the channel 80 is preferably at least as great as the range of movement of the pin 74 in the door 22. The range of movement of the pin 74 is preferably constrained by a pin slot 82 in the door 22 through which the pin 74 extends.

Use of the float 72, pin 74 and open slot 78 also acts as a resetting mechanism. When the fluid level drops sufficiently, the pin 74 can be lower than the opening in the open slot 78 if the door 22 is at a substantially perpendicular position relative to ground. The door 22, however, may not be perpendicular until the weight of the door 22 overcomes the force of the current of fluid pushing against the door 22. To assist the resetting process, one or more guides 84 can be disposed on the frame 10. The guides 84 can be used to position the pin 74 in the open slot 78. The guides 84 can be used when the door 22 returns to a substantially perpendicular position, which occurs when the level of fluid is lower than the opening in the open slot 78. The guides 84, which can be disposed on both sides of the open slot 78, can be angled upward to position the pin 74 upward as the door 22 rotates to a substantially perpendicular position. Once the door 22 reaches this position, the pin 74 can be at the level of the opening of the open slot 78, such that when the pin 74 is positioned over the opening, the pin 74 can fall into the open slot 78 thereby resetting the latching mechanism 70.

The latching mechanism 70 can be any structure suitable for sensing the level of fluid passing through the vent 8 and for releasing the door 22 at a preset fluid level. Additional structures, such as paddles, levers, tabs, and paddle wheels, can be used independently, or in addition to the above-described latching mechanism 70 to sense the fluid level and to release the door 22.

Fluids flowing through the vent 8 may rise and recede very slowly, or in the case of a storm surge, can rush in very quickly. The latching mechanism 70 can be configured to utilize the force of flowing fluids to release the door 22. Referring to FIGS. 12*a*–12*d*, the latching mechanism 70 can include an actuating structure 160, which can translate the force of flowing fluids into a lifting force to release and open the door 22. The actuating structure 160 can include a float 172. The float 172 can be configured to have a paddle-like configuration so that it can be displaced along a predetermined trajectory by the force of flowing fluids, such as water.

Figure 12A:
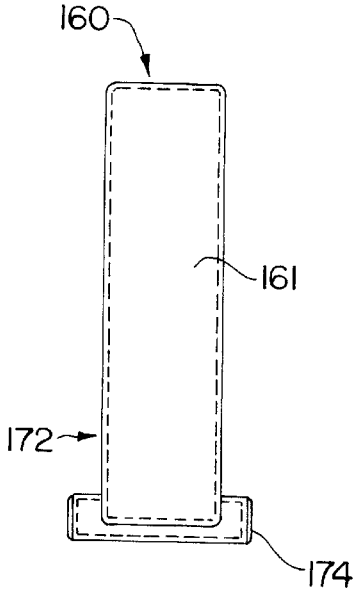
FIG. 12*a* is a front elevation view of a float according to another preferred embodiment of the invention.
Figure 12B:
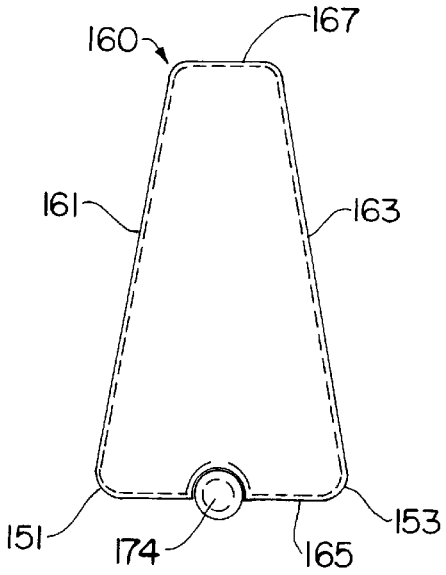
FIG. 12*b* is a side elevation view of the float illustrated in FIG. 12*a*.
Figure 12C:
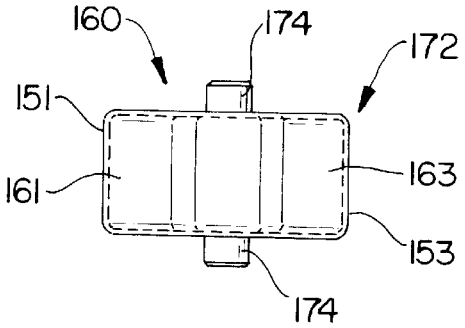
FIG. 12*c* is a top plan view of the float illustrated in FIG. 12*a*.
Figure 12D:
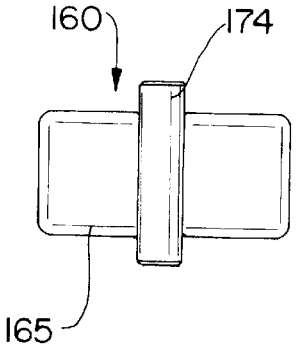
FIG. 12*d* is a bottom plan view of the float illustrated in FIG. 12*a*.
Figure 13:
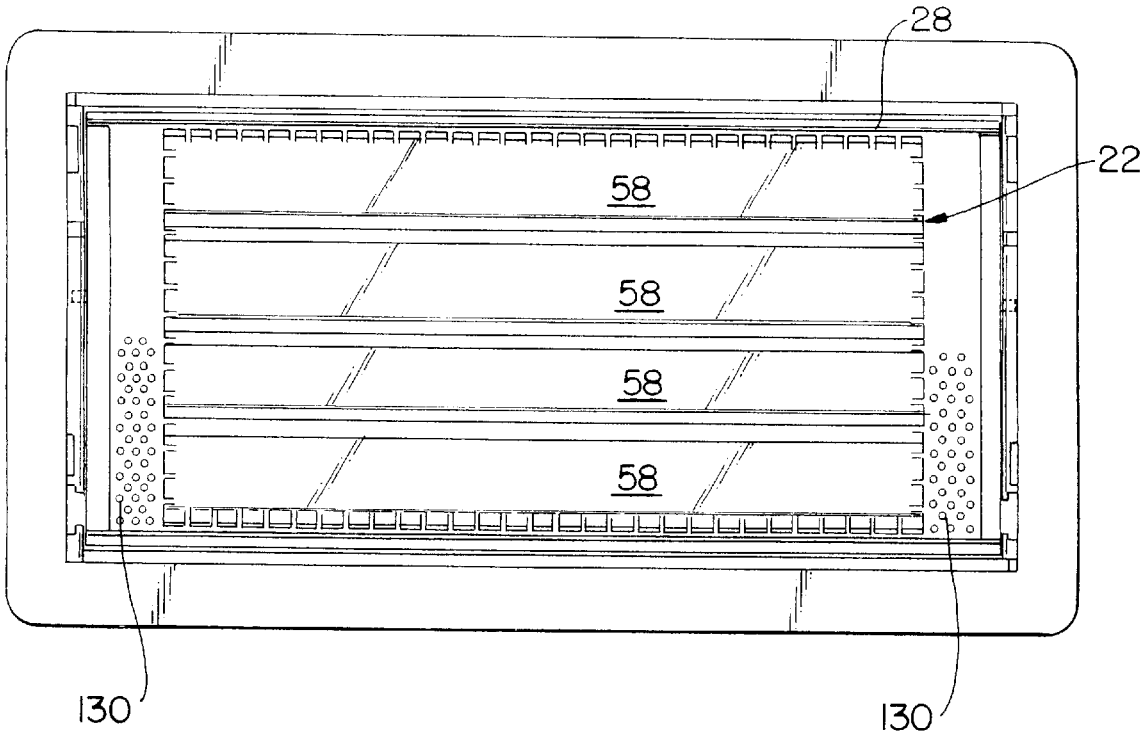
FIG. 13 is a front elevation of a door frame according to another embodiment of the invention.

The float 172 preferably has a bottom surface 165 contacting a float pin 174. The float 172 can have any suitable configuration, however, the float 172 is preferably configured to translate the force of fluids flowing through the vent 8 into an actuating force to release the float pin 174 from the open slot 78 thereby causing the door 22 to open. As shown in FIG. 13, the door 22 can include one or more apertures 130 to channel flowing fluids directly to the float 172. Turning back to FIG. 12*b*, in one arrangement, the float 172 can have a paddle-like configuration with a front surface 161 and a rear surface 163. The front and rear surfaces 161, 163 can be oriented substantially perpendicular to the direction of inward and outward fluid flow within the vent 8. In the illustrated embodiment, the front and rear surfaces 161, 163 flare outwardly to provide a narrower upper portion 167 and a wider bottom surface 165; however, the invention is not limited in this regard, as the float 172 can be any configuration suitable for transforming forces from flowing fluids into rotation by the door 22. The front and rear surfaces 161, 163 can intersect with the bottom surface 165 to define lower edges 151, 153. The lower edges 151, 153 can be any suitable shape in order to serve as rotational points to allow the float 172 to pivot backwards or forwards on a surface. For example, the lower edges 151, 153 can be rounded, as shown in FIG. 12*b*. In addition, the lower edges 151, 153 can also be sharp corners.

Figure 14C:
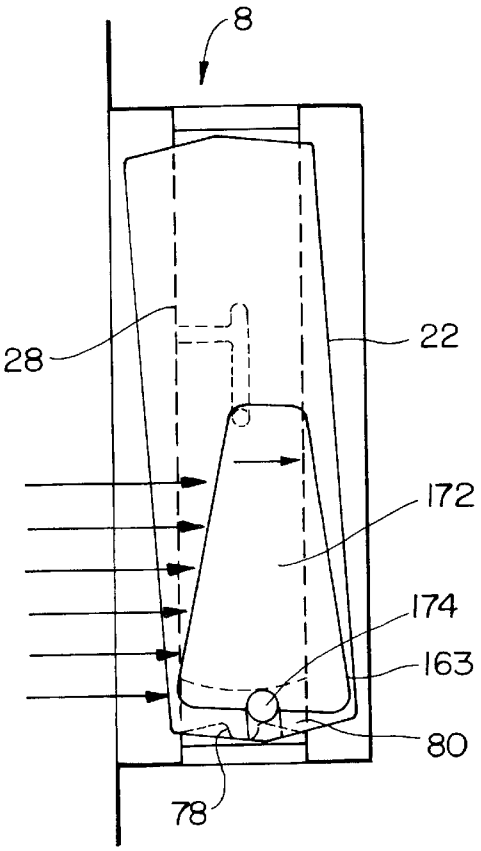
Figure 14B:
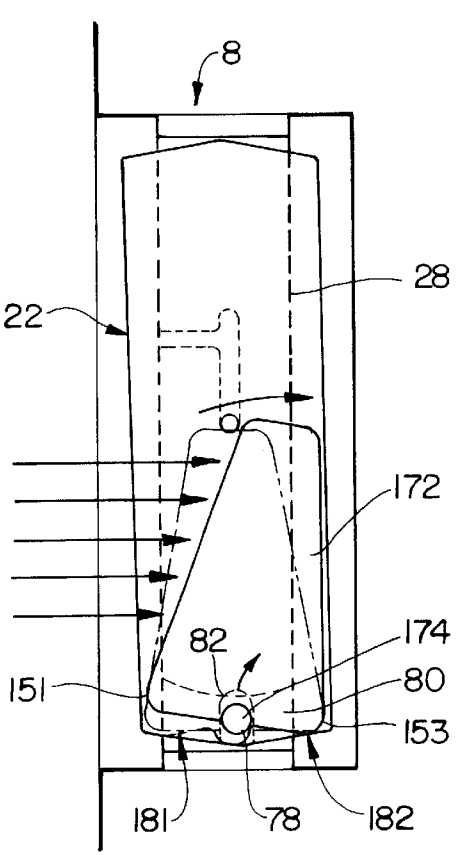
FIG. 14*b* is a cross-sectional side elevation of the flood vent in FIG. 14*a* illustrating a pin being raised from a pin slot by the force of flowing fluid.
Figure 14A:
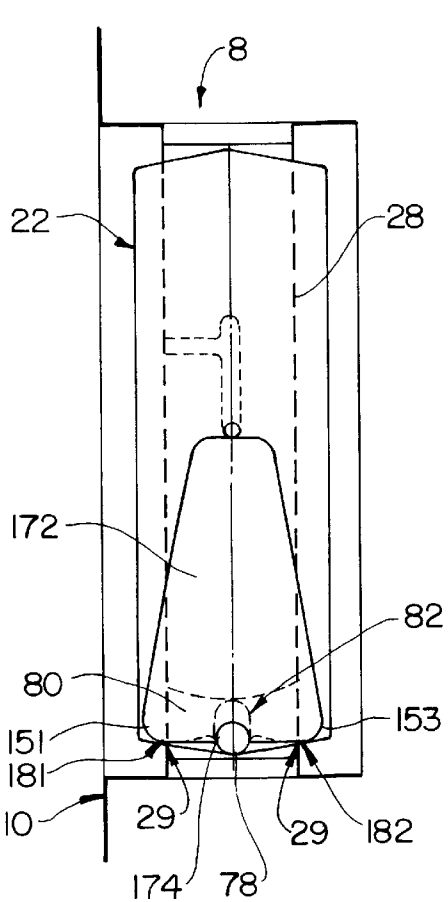
FIG. 14*a* is a cross-sectional side elevation of a flood vent according to another embodiment of the invention showing the position of a float therein when the flood vent is in a closed position.

FIGS. 14*a*–14*f* illustrate the float 172 within the door 22. FIG. 14*a* shows the position of the float 172 when the fluid level within the vent 8 is not sufficient to displace the float 172. The door 22 can be in a vertical, closed position, and the float pin 174 can be seated in the open slot 78. When the float 172 is not displaced by the fluid within the vent 8, the rounded edges 151,153 can rest on the base 29 of the door frame 28. The open slot 78 can be configured to functionally engage the configuration of the float 172 to facilitate the opening of the door 22 when the fluid rises to a sufficient level. The rounded edges 151, 153 can allow the float 172 to rotate about oppositely disposed fulcrum points 181,182 on the base 29.

FIGS. 14*b*–14*f* illustrate the action of flowing fluid on the float 172. As seen in FIG. 14*b*, flowing fluid can enter the door 22 through the apertures 130 (FIG. 13) in the door frame 28. The force of the flowing fluid can tilt the float 172 and can cause the float 172 to pivot on the rounded edge 153 at the fulcrum point 182. This motion can lift the float pin 174 out of the open slot 78, which can release the door 22 thus permitting the door 22 to swing open with the flow of the fluid. The pin slot 82 in the door frame 28 can constrain the upward movement of the float 172. In FIGS. 14*c* and 14*d*, the force of the flowing fluid can push the rear surface 163 of the float 172 against the door 22 thereby forcing the door 22 into the open position. As shown in FIG. 14*e*, it can be seen that the channel 80 can allow the passage of the pin 174 through the frame 10. As seen in FIG. 14*f*, once the door has rotated into the fully open position, the force of the current and the buoyancy of the float 172 can maintain the door 22 in the open position. The float 172, door frame 28 and channel 80 are preferably symmetrically constructed to allow the door 22 to be opened by the inflow and outflow of fluid into the vent 8.

After the fluid level has dropped, the above-described arrangement of the float 172, the float pin 174, door frame 28 and the open slot 78 can function as a resetting mechanism. That is, when the fluid level has sufficiently receded, the float 172 can tilt on the fulcrum point 182 back to its original position, and the float pin 174 can rotate back into the open slot 78 to latch the door 22.

In the event that the incoming fluid rises slowly and does not have sufficient current flow to push the float 172, the buoyancy of the float 172 can lift the float pin 174 out of the open slot 78, and the door 22 can be released in the manner described in the previous embodiment. The door 22 can thus be released by the buoyancy of float 172, by the force of flowing fluid pushing on the float 172, or by a combination of these two methods working in cooperation to release the door 22.

Figure 15:
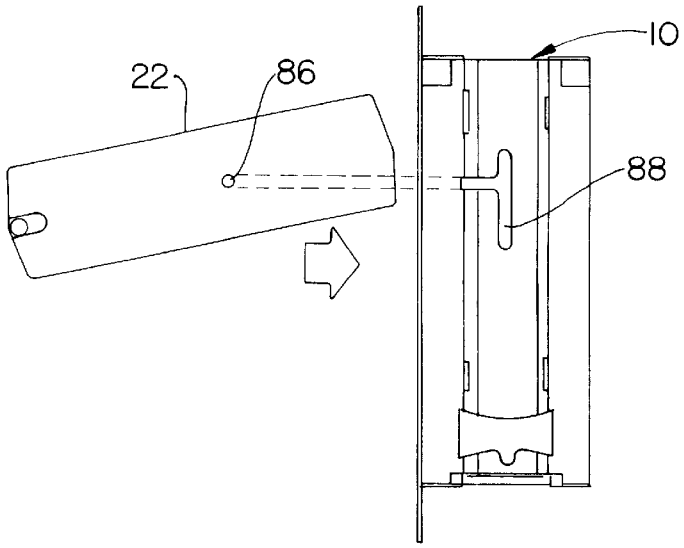
FIG. 15 is a side elevation of a door and a frame before insertion of the door into the frame.
Figure 16A:
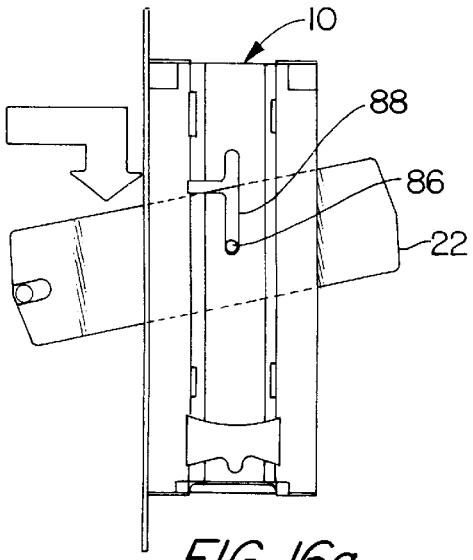
FIG. 16*a* is a side elevation of a door and a frame showing the positional relationship of the door to the frame during insertion of the door into the frame.
Figure 16B:
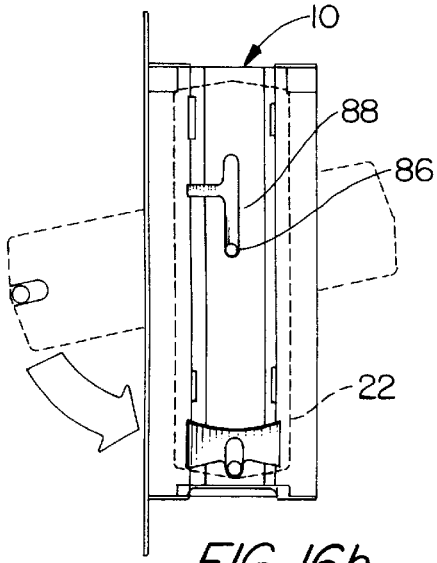
FIG. 16*b* is a side elevation of a door and a frame illustrating the positioning of the door in FIG. 16*a* to a closed position.

FIGS. 15 and 16 illustrate one way to insert the door 22 into the frame 10. As shown in FIG. 15, the door 22 can be held substantially perpendicular to the frame 10 and can then be inserted into the frame 10 by positioning the door pins 86 on the door 22 into the opening of the door slot 88 in the frame 10. The opening of the door slot 88 can be positioned slightly higher than the final vertical position of the door pins 86 so that the door 22 can be rotated substantially perpendicular to the frame 10. Once each pin 86 is in its respective door slot 88, the door pin 86 can be constrained from movement in any direction except along the length of the door slot 88. The bottom of the door slot 88 can define the final horizontal and vertical position of the door pins 86.

As shown in FIG. 15, the configuration of the door slot 88 can limit the translational movement of the door pin 86, even if the door pin 86 is moved slightly upward. Also, this feature can prevent the door 22 from being removed from the frame 10 when the door 22 is in a closed positioned. Thus, to remove the door 22, the door 22 must be positioned at an angle so that the door pins 86 can be lifted upward in the door slot 88 and then towards the opening of the door slot 88. A portion of the door slot 88 can continue vertically past the opening of the door slot 88 which can reduce the possibility of unauthorized or accidental removal of the door 22. In addition, a retainer (not pictured) can be added to the door slot 88, which can be removed only with a special tool. As a result, the retainer can prevent unauthorized entry.

Figures 17A, 17B, 17C, 17D:
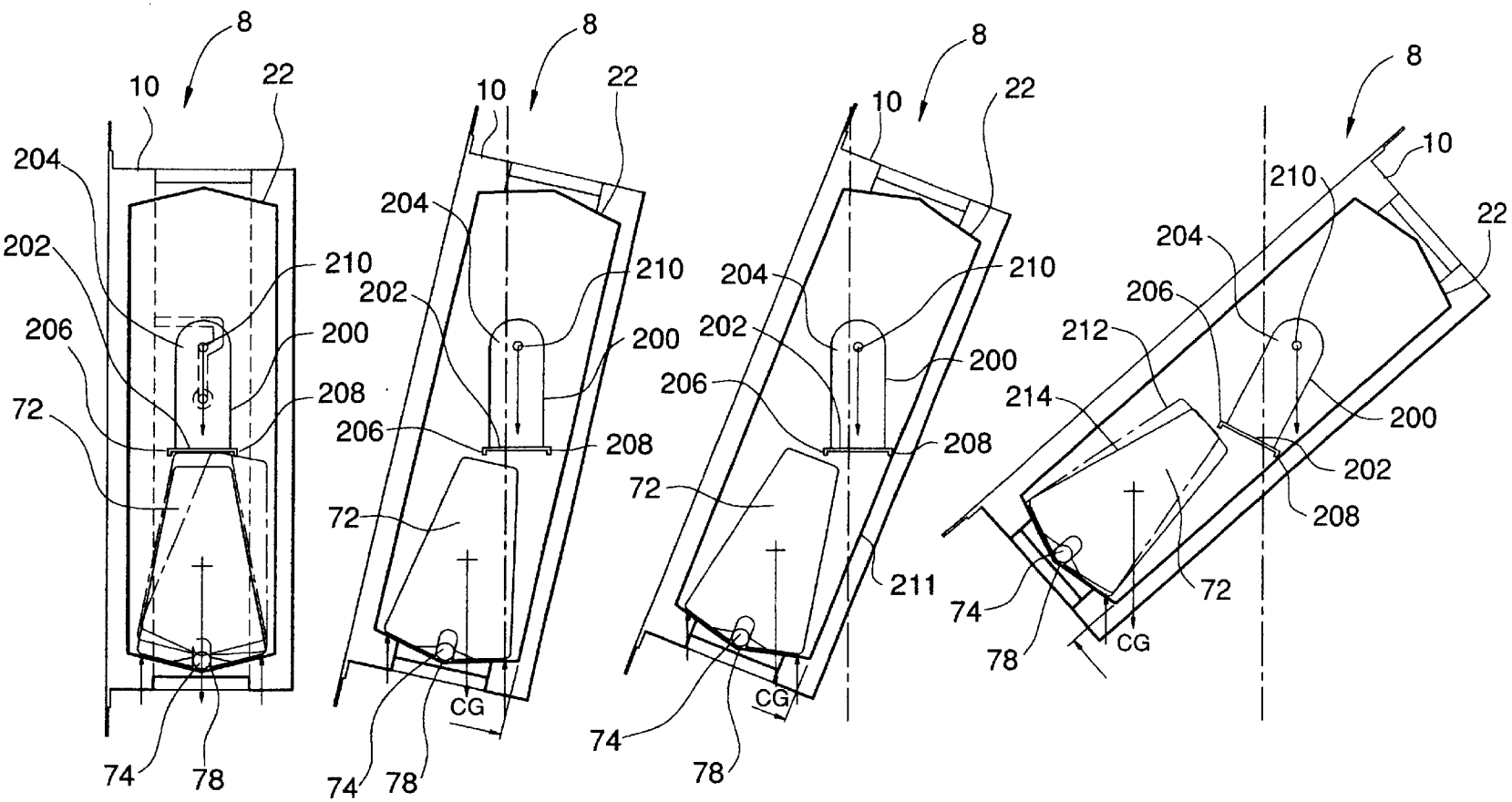
FIG. 17*a* is a cross-sectional side view of another vent including a bracket.
FIGS. 17*b–d* are cross-sectional side views of the embodiment shown in FIG. 17*a* showing the embodiment in various positions during operation while the structure in which the embodiment is mounted is rotated.

FIGS. 17*a*–*d* depict another embodiment of vent 8. Specifically, FIG. 17*a* is a cross-sectional side view of a vent 8 having a retention mechanism for preventing the door from opening while frame 10 is rotated from a generally vertical position to a generally horizontal position. In one embodiment, the retention mechanism is a bracket 200 for preventing flood door 22 from opening when the structure to which vent 8 is attached is moved or rotated from a generally vertical position, referred to as a resting position, to a generally horizontal position. For instance, if vent 8 is installed in a conventional overhead garage door, as shown in FIG. 17*a*, bracket 200 prevents flood door 22 from opening while the garage door is being moved into a generally horizontal position. Vent 8 having bracket 200 is useful in any door or wall that that undergoes a change in position that would cause flood door 22 to open as a result of this change in orientation.

Bracket 200 may be composed of numerous configurations. For instance, as shown in FIGS. 17*a–d*, bracket 200 is generally L-shaped and composed of a stop surface 202 coupled to a rotatable arm 204, which may be rotatably attached to frame 10 or flood door 22. Rotatable arm 204 is generally parallel to frame 10. Stop surface 202 is generally flat and may include stop edges 206 and 208 for restricting movement of float 72. Stop edges 206 and 208 are projections that extend generally orthogonally from stop surface 202. Stop surface 202 is coupled to an end of rotatable arm 204 and is generally perpendicular to arm 204. However, stop surface 202 may be coupled to arm 204 in other configurations that allow bracket 200 to function as described below. Bracket 200 is not limited to the exemplary embodiment shown in FIGS. 17*a–d*. Rather, bracket 200 may be configured from any shaped device that prevents flood door 22 from opening by preventing a locking mechanism from releasing flood door 22. In this embodiment, bracket 200 prevents float pin 74 from leaving open slot 78.

Bracket 200, as shown in FIGS. 17*b–d*, prohibits flood door 22 from opening by preventing float pin 74 from being released from open slot 78. As the structure in which flood door 22 is installed, which will be referred to hereinafter as a garage door, is rotated away from a vertical position, as shown in FIG. 17*b*, bracket 200 pivots about pivot 210 and remains in a generally vertical position. However, float 72 does not remain in a generally vertical position, but initially begins to rotate with the garage door. As the garage door continues to rotate towards a horizontal position, float 72 does not continue to rotate with frame 10, as shown in FIG. 17*d*. Rather, float 72 moves from initial position 212, shown in dashed lines, to a second position 214 in which float 72 contacts stop edge 206. Stop edge 208 then contacts an interior wall 211 of flood door 22 and prevents float 72 from additional rotation. As the garage door continues to rotate, flood door 22 is prevented from opening. Therefore, bracket 200 enables an overhead garage door containing flood door 22 to be rotated into a generally horizontal position while preventing flood door 22 from opening.

Figure 18:
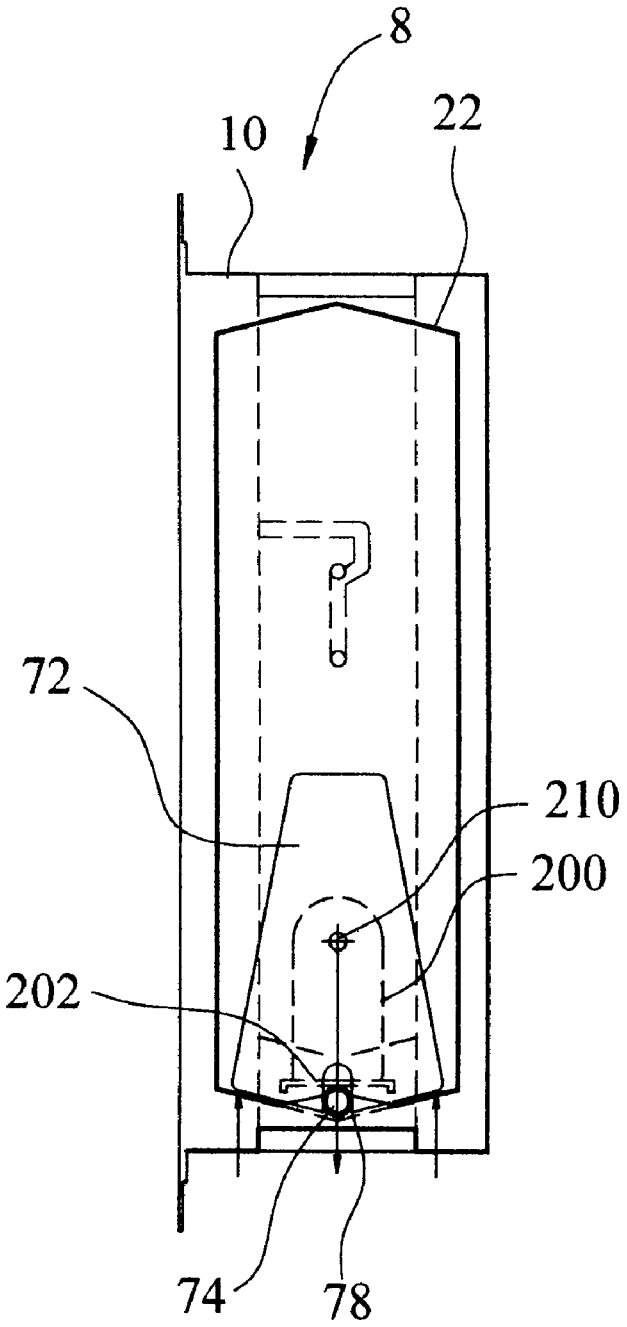
FIG. 18 is a cross-sectional side view of another vent including a bracket.

In another embodiment, bracket 200 may be configured to prevent flood door 22 from opening by contacting float pin 74 directly, rather than by contacting float 72 as described above. In this embodiment, bracket 200 may have the same or different configuration than shown in FIGS. 17*a–d*. As shown in FIG. 18, bracket 200 may be rotatably coupled to frame 10 and positioned proximate to float pin 74. Bracket 200 is configured and positioned so that float pin 74 can travel a sufficient distance to allow flood door 22 to open while frame 10 is generally vertical; yet, prohibit float pin 74 from be released from open slot 78 while frame 10 is rotated toward a horizontal position.

Figure 19C:
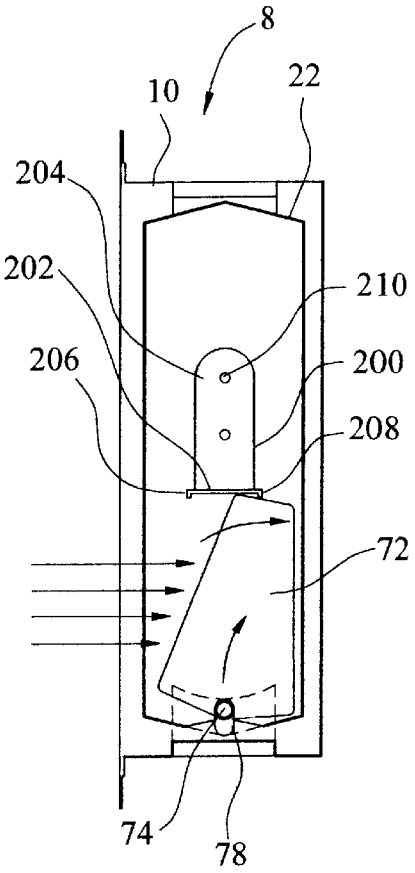
FIGS. 19*a–f* are cross-sectional side views of a vent including a bracket shown in various positions during operation while flood water passes through the frame.
Figure 19B:
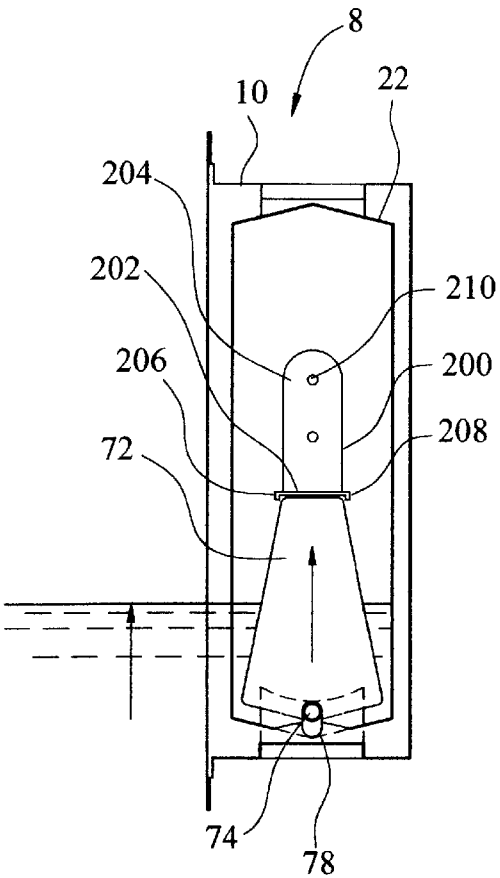
Figure 19A:
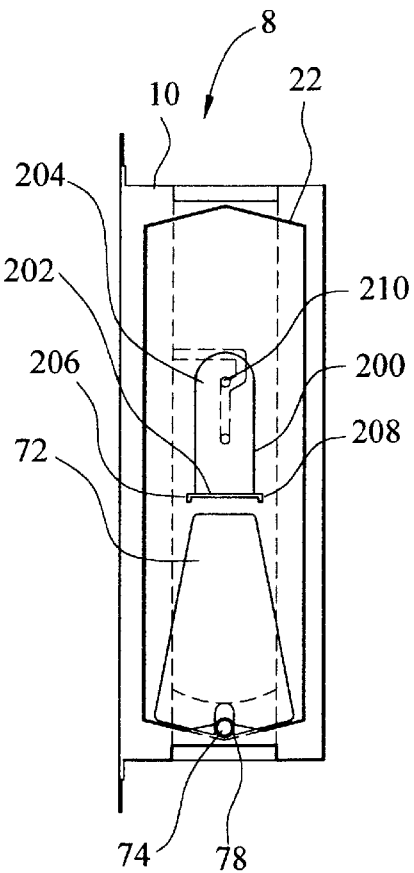
Figure 19F:
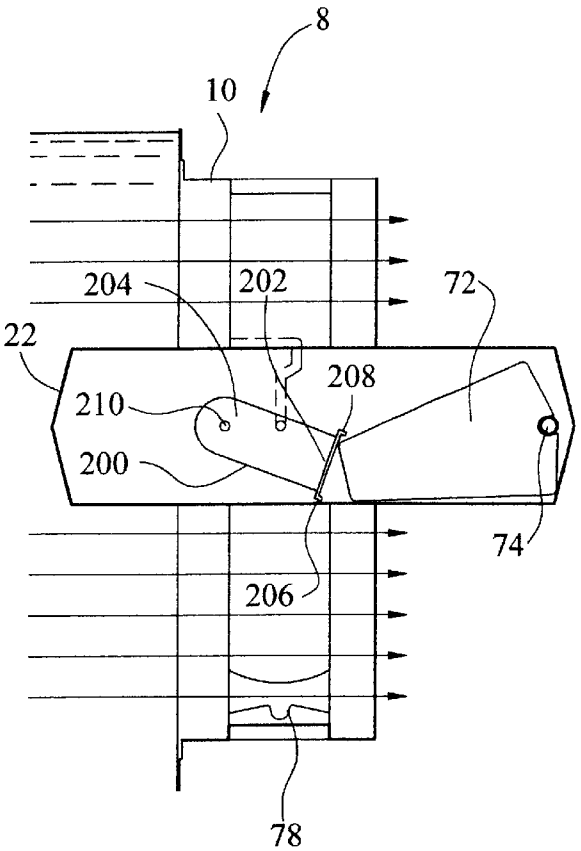
Figure 19E:
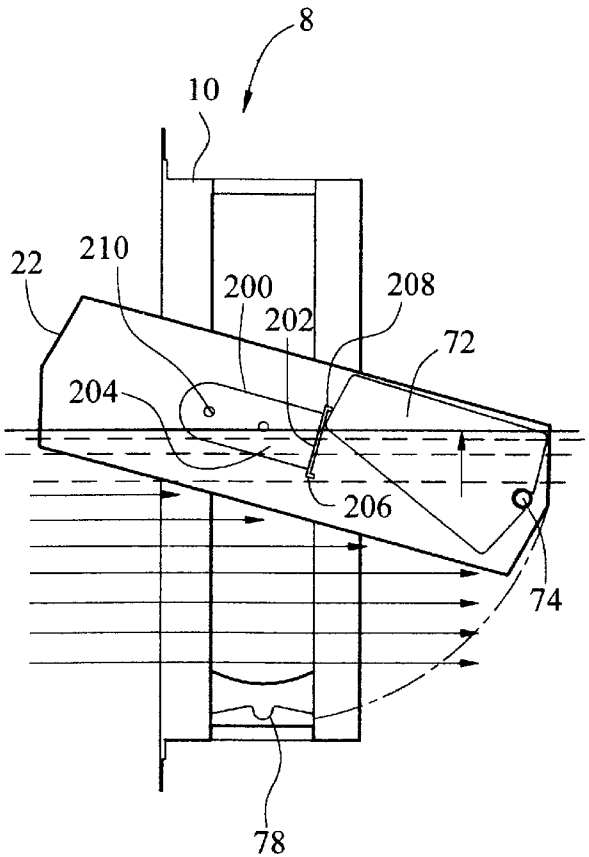
Figure 19D:
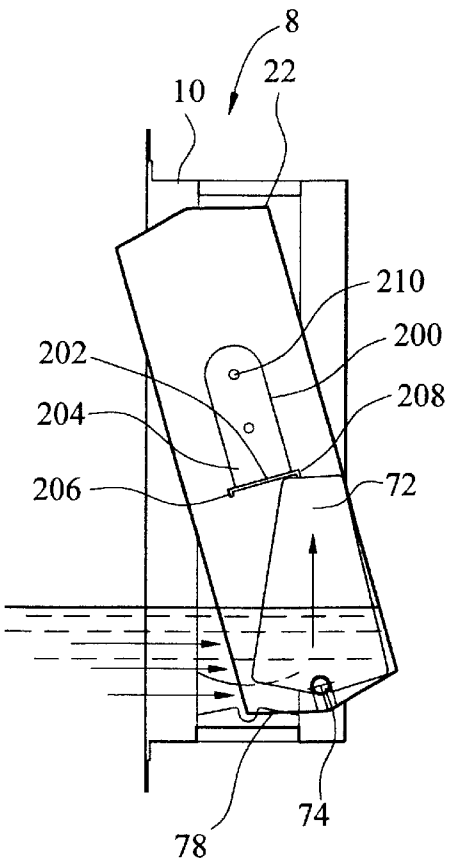

FIGS. 19*a–f* depict a fluid, such as flood water, opening flood door 22 having a bracket 200. Bracket 200 is positioned on frame 10 relative to float 72 so that float 72 is capable of moving a sufficient amount to release floating pin 74 from open slot 78. As the level of flood water rises, float 72 floats upward, as shown in FIG. 19*b*, or rises and tilts to one side, as shown in FIG. 19*c*, which may be caused by the flow of flow water. This movement of float 72 causes floating pin 74 to be removed from open slot 78. The force of the flood water then causes flood door 22 to open, as shown in FIG. 19*d*. In addition, float 72 is buoyant, which causes flood door 22 to open as float 72 rests on the surface of the water. Flood door opens partially, as shown in FIG. 19*e*, when the level of flood waters is within the opening regulated by flood door 22. Furthermore, float 72 partially fills with water after at least some air contained within float 72 has escaped. As the level of flood waters surpasses the opening regulated by flood door 22, as shown in FIG. 19*f*, flood door 22 rotates into and remains in a generally horizontal position. In addition, float 72 becomes completely filled with flood water.

Figure 20:
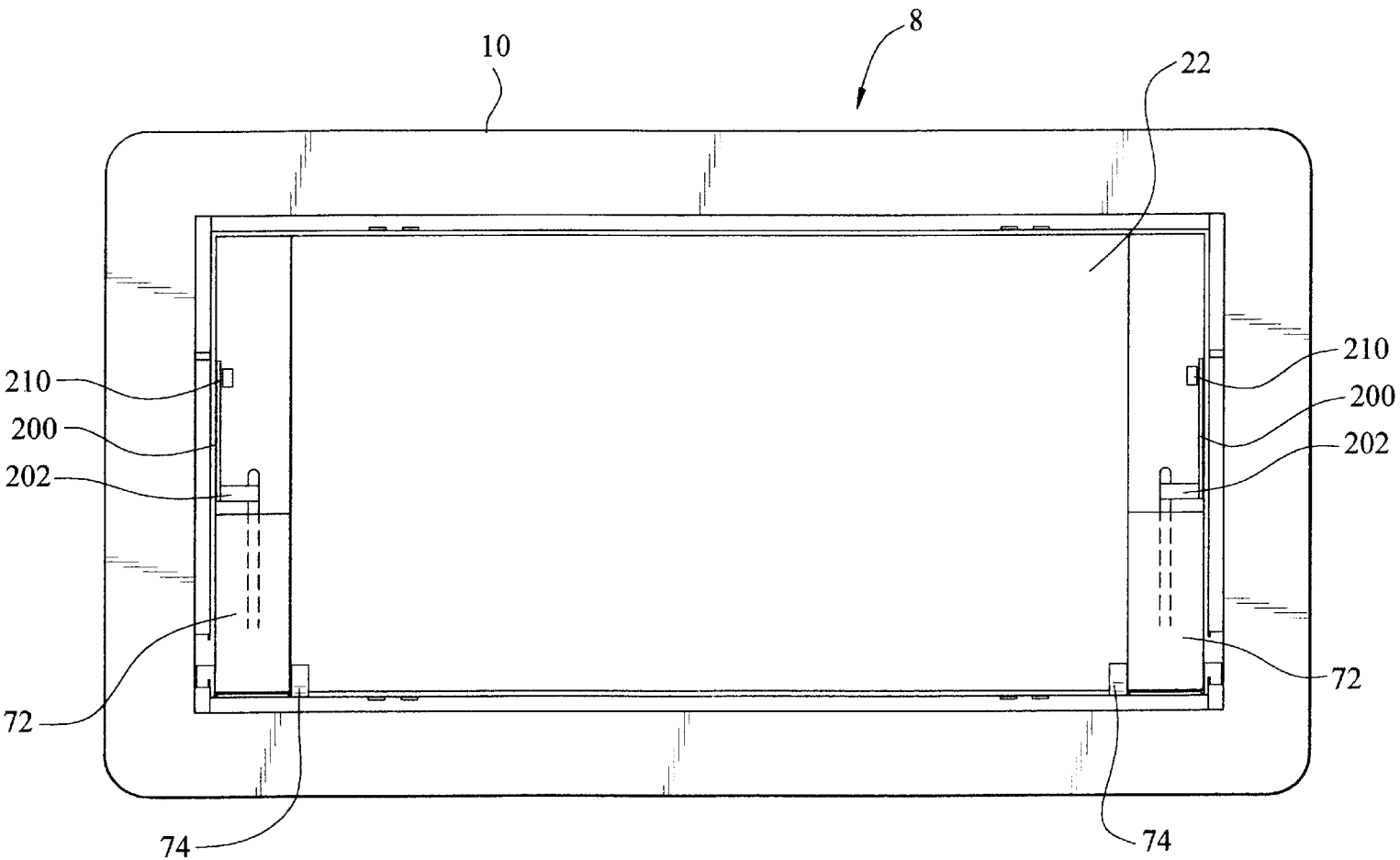
FIG. 20 is a cross-sectional front view of a vent having a solid flood door including two brackets.
Figure 23:
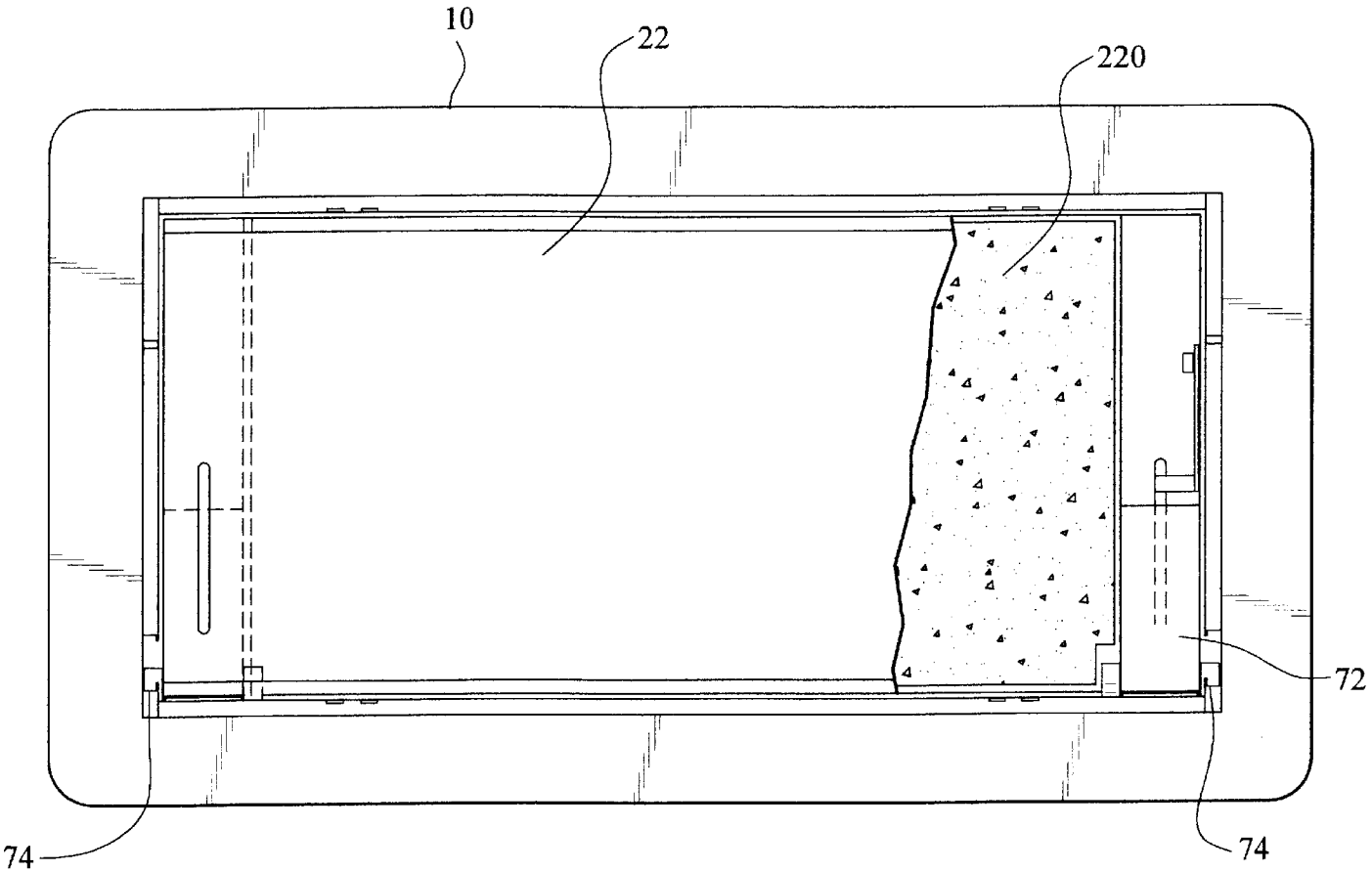
FIG. 23 is a partial-sectional front view of a vent having an insulated solid flood door including two brackets.

Flood door 22 may include louvers, as described above and shown in FIGS. 7, 10 and 13, or may include a solid outer surface, as shown in FIG. 20. In addition, flood door 22, as shown in FIG. 23, may or may not include insulation 220. A solid outer surface is desirable in flood prone areas where ventilation is not required or desired, such as, air conditioned first floor entries and garages.

Figure 22:
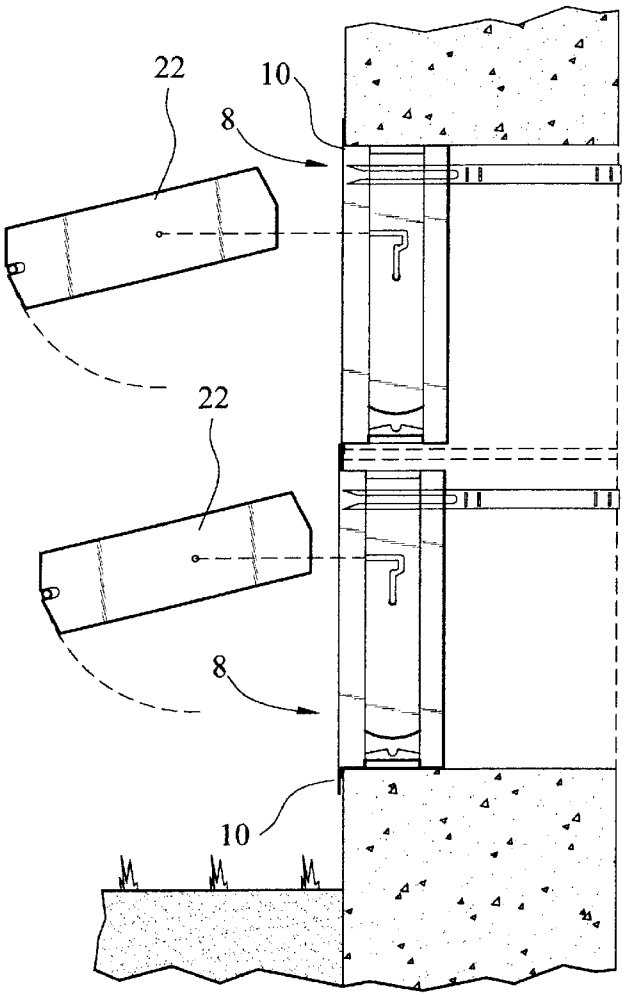
FIG. 22 is a side view of the vents of FIG. 21.
Figure 21:
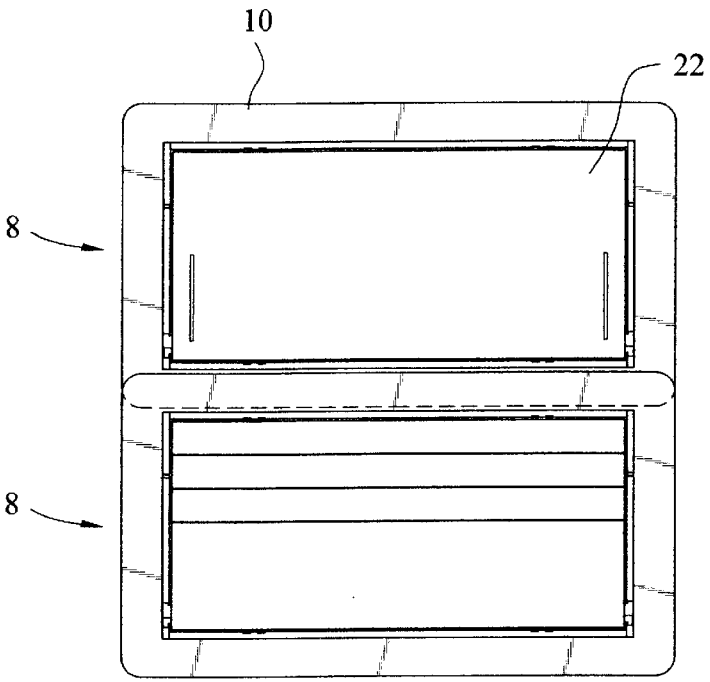
FIG. 21 is a front view of modular stacked vents having a solid doors.

As shown in FIGS. 21 and 22, vents 8 may be installed in a stacked, modular formation in a wall forming a portion of a house or other structure or in an overhead garage door. Such a formation may be desirable in flood prone areas where the number of vents required for proper ventilation would make the foundation structurally unsound if the vents were placed side by side. This formation is also desirable when a foundation is not formed from concrete block but formed from poured concrete where it is more desirable to make holes of larger size but fewer in number than numerous openings having small sizes. In this formation, each vent 8 may or may not act independently from each other.

It should be understood that the examples and embodiments described herein are for illustrative purposes only and that various modifications or changes in light thereof will be suggested to persons skilled in the art and are to be included within the spirit and purview of this application. The invention can take other specific forms without departing from the spirit or essential attributes thereof for an indication of the scope of the invention.

What is claimed is:

1. A flood gate, comprising:

a frame forming a fluid passageway;

a door pivotally mounted to the frame in the fluid passageway for allowing a fluid to flow through the fluid passageway;

a float for controlling the door; and a bracket for preventing the float from moving to a position that allows the door to open if the frame is rotated from a resting position towards a generally horizontal position and for allowing the door to open after being actuated by the float when the frame is in the resting position.

2. The flood gate of claim 1, wherein the bracket comprises at least one arm rotatably coupled to the frame.

3. The flood gate of claim 1, wherein the bracket comprises at least one arm rotatably coupled to the door.

4. The flood gate of claim 3, wherein the bracket comprises at least one stop edge coupled to the at least one arm.

5. The flood gate of claim 3, wherein the bracket comprises an L-shaped bracket.

6. The flood gate of claim 1, further comprising a locking mechanism for preventing the flood door from opening.

7. The flood gate of claim 6, wherein the locking mechanism is comprised of at least one pin coupled to the float and configured to fit in a slot.

8. The flood gate of claim 7, wherein the bracket is positioned to contact the pin.

9. The flood gate of claim 1, wherein the float is positioned in the door.

10. The flood gate of claim 1, wherein the bracket is positioned to contact the float.

11. A flood gate, comprising:

a frame forming a fluid passageway;

a door pivotally mounted to the frame in the fluid passageway for allowing a fluid to flow through the fluid passageway;

a locking mechanism for preventing the door from opening until a particular level of flood water is present; and a retention mechanism for preventing the door from opening while the frame is rotated from a generally vertical position to a generally horizontal position.

12. The flood gate of claim 11, wherein the flood gate comprises a float and the locking mechanism comprises at least one pin coupled to the float and adapted to rest in a slot.

13. The flood gate of claim 12, wherein the retention mechanism is an arm.

14. The flood gate of claim 13, wherein the arm is positioned to contact the float.

15. The flood gate of claim 13, wherein the arm is positioned to contact the at least one pin.

16. A flood gate, comprising:

a frame forming a fluid passageway;

at least two doors pivotally mounted to the frame in the fluid passageway for allowing a fluid to flow through the fluid passageway;

at least one latching mechanism for holding the at least two doors in a closed position, said latching mechanism releasing the at least two doors when a fluid reaches a level;

at least one float for controlling the at least two doors; and a bracket for preventing the at least one float from moving a distance sufficient to allow the at least two doors to open if the frame is rotated from a resting position and for allowing the at least two doors to open after being actuated by the at least one float when the frame is in the resting position.

* * * * *